US005156037A

United States Patent [19]

Bundy

[11] Patent Number: 5,156,037

[45] Date of Patent: Oct. 20, 1992

[54] CLAMPING APPARATUS FOR REPAIRING AN AUTOMOBILE CHASSIS

[76] Inventor: Douglas M. Bundy, 12268 N. Saginaw Rd., Clio, Mich. 48420

[21] Appl. No.: 684,540

[22] Filed: Apr. 11, 1991

[51] Int. Cl.[5] ..... B21D 1/12

[52] U.S. Cl. ..... 72/422; 72/705; 294/90

[58] Field of Search ..... 72/422, 705; 294/90, 294/91; 24/569

[56] References Cited

U.S. PATENT DOCUMENTS

| | | | |
|---|---|---|---|
| 1,951,064 | 3/1934 | Richards et al. | 294/90 |
| 2,836,219 | 5/1958 | Pertner | 72/705 |
| 3,577,881 | 5/1971 | Markovics . | |
| 3,765,220 | 10/1973 | Kirspel | 72/705 |
| 3,797,295 | 3/1974 | Sanchez . | |
| 3,827,279 | 8/1974 | Buske . | |
| 3,955,249 | 5/1976 | Shiozaki . | |
| 4,584,863 | 4/1986 | Gaston et al. . | |

*Primary Examiner*—Lowell A. Larson
*Attorney, Agent, or Firm*—Weintraub, DuRoss & Brady

[57] ABSTRACT

The present invention is directed to a clamping apparatus for securing to and pulling upon an enlarged end of a longitudinal member of an automobile or vehicle chassis. The clamping apparatus has a pair of facing jaw members each having a bearing portion, a pulling portion, and an intermediate portion therebetween. The bearing portions each have a groove that cooperate to substantially surround the periphery of the longitudinal member perpendicular to its longitudinal axis such that the clamping apparatus may not slide off the longitudinal member, while the hearing portions bear upon the enlarged end as an axial pulling force is transferred from the clamping apparatus to the automobile chassis.

9 Claims, 1 Drawing Sheet

CLAMPING APPARATUS FOR REPAIRING AN AUTOMOBILE CHASSIS

TECHNICAL FIELD

This invention relates generally to clamping devices and in particular to a clamping apparatus used to repair an automobile chassis or body structure.

BACKGROUND ART

Automotive vehicles involved in accidents typically suffer structural damage to members due to crushing. To repair this damage, the members must be either replaced or repaired. In the case where a member is to be straightened and repaired, often a clamping device or apparatus is secured to the member and pulled upon in a direction opposite to that of the crushing force which caused the damage.

One member frequently damaged is the energy absorbing unit which is connected between the vehicle bumper and the vehicle chassis. When the bumper is impacted, the impacting force is transferred from the bumper, axially through a longitudinal member, and to the energy absorbing unit causing the energy absorbing unit to plastically deform in a crushing or buckling mode. The bumper is typically bolted to an end plate attached to the longitudinal member.

Conventionally, the energy absorbing unit is straightened by removing the bumper and attaching a flat pulling plate, through numerous bolted connections, to the end plate. The same apertures used to bolt the bumper to the end plate are used to attach the pulling plate. The pulling plate is then pulled upon transferring a pulling force through the bolts, the end plate, the longitudinal member and finally to the energy absorbing unit, thereby straightening the energy absorber unit. Disadvantages to using the pulling plate are that numerous bolted connections must be fastened and unfastened and the pulling plate cannot readily be used to secure to other vehicle components.

Examples of clamps securing to vehicle components to apply a pulling load thereto are disclosed in the following U.S. patents.

Sanchez, U.S. Pat. No. 3,797,295, discloses a clamp assembly with a pair of jaw members for securement to the drip molding of an automobile. One jaw member has a trough sized to cooperatively engage, in conjunction with the other jaw member, the drip molding. The jaw members are designed to pull perpendicular to rather than axially along, the drip molding. Also, they are held together by a clamping bolt located intermediate abutting portions on each of the jaw members, which impedes securement about a member located in the space formed between the jaw members. Finally, an attachment means secures to only the jaw member having the trough and therefore, the axial load is predominantly carried by that jaw member relative to the remaining jaw member.

Shiozaki, U.S. Pat. No. 3,955,249, discloses a clamping device with a pair of jaw members having serrated teeth that bite upon a member to be clamped. The clamping device must be under a tensile load in order to actuate the clamping action. Further, the device will not flushly bear upon a component held within the space located between the jaws when the clamp is being pulled, thereby avoiding localized areas of high load transfer. The clamp is not designed to stably secure about the periphery of a longitudinal member perpendicular to its longitudinal axis so as to provide an axial pulling load to a longitudinal member.

Buske, U.S. Pat. No. 3,827,279 discloses a clamp with a pair of facing angle-shaped jaws which are secured together by a clamping screw. The clamp is designed to bite upon a component held between interdigitating cup-shaped teeth located on each of the jaws. A clamp screw passes intermediately through each of the jaws thereby reducing the unencumbered spaced located between the biting ends of the jaws and the clamping screw. Again, the clamp is not well suited to secure about the periphery of a longitudinal member to apply an axial pulling load thereto.

Other patents related to automobile pulling tools include Markovics, U.S. Pat. No. 3,577,881 and Gaston et al, U.S. Pat. No. 4,584,863.

DISCLOSURE OF THE INVENTION

The present invention is a clamping apparatus for securing to and axially pulling upon an enlarged end of a longitudinal member, such as the end plate attached to the longitudinal member which secures to an energy absorbing unit or the like. The apparatus includes a pair of facing or opposing jaw members which are releasably clamped together by a clamping means such a clamping bolt. Each jaw member has a bearing portion, a pulling portion and an intermediate portion therebetween. The bearing and intermediate portions define an unencumbered space therebetween sufficiently large to receive the enlarged end of the longitudinal member. Each of the bearing portions has a bearing face and a terminal end with a groove located therein. The grooves are sized such that they may cooperatively and substantially surround the periphery of the longitudinal member perpendicular to its longitudinal axis. The jaw members may be placed about the longitudinal member with the groove surrounding the longitudinal member and with the bearing faces bearing upon the enlarged end such that an axial pulling force applied to either of the jaw members will be transferred axially to the longitudinal member primarily through the bearing faces upon the enlarged end.

Preferably, the unencumbered space between the jaw members is sufficiently large such that transverse members of substantial size, i.e. a rail, a door pillar, a rocker panel, or the like, may be placed therebetween with the apparatus pulling perpendicular to the longitudinal axis of these transverse members, thereby applying a beam-type load.

Also, preferably, the apparatus further includes an attachment means such that a pulling load applied to the jaw members will transfer approximately equally in magnitude, and over rather large bearing areas, by each of the bearing faces to a member secured therewithin.

An important object of the present invention is to overcome the disadvantages and problems encountered with prior art attachment devices used for automobile repair.

Another object is to provide a clamping apparatus having a pair of facing jaw members that secure about an enlarged end of a longitudinal member with the use of a single clamping bolt.

Another object is to provide a clamping apparatus with cooperating grooves, located in each of the jaw members, such that the grooves substantially surround the periphery of a longitudinal member perpendicular to its longitudinal axis, such that an axial pulling force is applied to the enlarged end of the longitudinal member by bearing faces located on each of the jaw members.

Still another object is to provide a clamping apparatus with a substantial unencumbered free space, located between cooperating jaw members, such that components of substantial cross-sectional size may be secured therewithin.

Yet a further object is to provide an attachment means wherein an axial pulling load applied to the jaw members will be relatively evenly distributed between each of the jaw members such that each jaw member bearing upon a component secured between the jaw members will transfer loads of approximately equal magnitude, rather than having one jaw member transfer the large majority of the load to the secured component.

Still a further object is to provide a clamping apparatus having bearing portions of sufficient size and structural stiffness such that the bearing area upon a component is large thereby avoiding localized areas of high load transfer which may cause damage to the component.

A more specific object of my invention is to provide a clamping apparatus for securing to and pulling upon an enlarged end of a longitudinal member of a vehicle chassis. The apparatus comprises a pair of opposing or facing jaw members located along a longitudinal axis. Each jaw member has a bearing portion, a pulling portion, and an intermediate portion defining an unencumbered space therebetween sufficiently large to receive the enlarged end of the longitudinal member. The clamping apparatus further comprises a clamping means for releasably clamping the pulling portions to retain the jaw members in facing or opposing relation. Also included in the clamping apparatus is attachment means for applying a pulling force to at least one of the pulling portions. The bearing portions each have a bearing face and a terminal end with a groove located therein, the grooves being sized to cooperatively and substantially surround the periphery of the longitudinal member perpendicular to its longitudinal axis such that the jaw members may not slide off the longitudinal member. The jaw members may be placed with the grooves substantially surrounding the longitudinal member and with the bearing faces bearing upon the enlarged end such that a pulling force applied to either of the pulling portions will be transferred to the vehicle chassis primarily through the bearing faces upon the enlarged end, thereby placing an axial tensile load upon the longitudinal member.

Other objects, features and advantages will become more readily apparent from the following description and accompanying sheets of drawings.

BEST MODE FOR CARRYING OUT THE INVENTION

Figure 1:
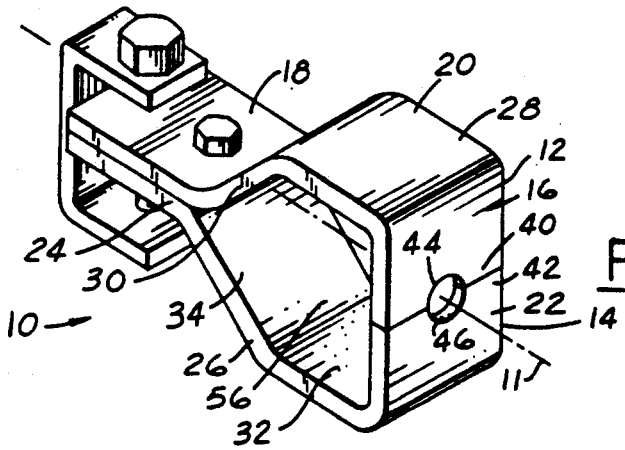
FIG. 1 is a perspective view of a clamping apparatus, made in accordance with the present invention, having a pair of facing or opposing jaw members which are secured together by a clamping bolt.

FIG. 1 shows a clamping apparatus 10 having facing jaw members 12 and 14 located about a longitudinal axis 11. Jaw member 12 has a bearing portion 16, a pulling portion 18, and an intermediate portion 20 located therebetween. Similarly, jaw member 14 has a bearing portion 22, a pulling portion 24, and an intermediate portion 26 therebetween. Intermediate portions 20 and 26 have transverse portions 28 and 32 and diagonal portions 30 and 34, respectively.

Figure 2:
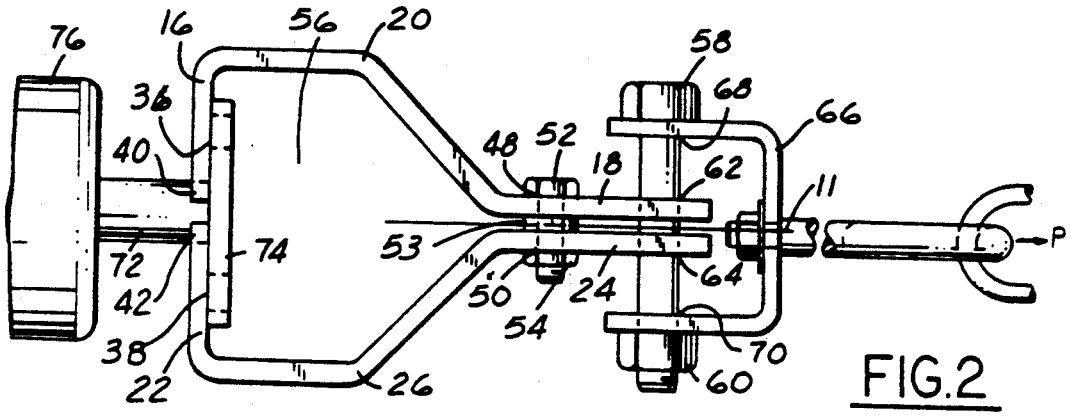
FIG. 2 is a side elevational view of the clamping apparatus having grooves substantially surrounding the periphery of a longitudinal member and having a bearing portion bearing on an end plate such that an axial pulling load is transferred to the end plate by the bearing portion.

As shown in FIG. 2, on the inside of bearing portions 16 and 22 are bearing faces 36 and 38, which are preferably planar, and extend perpendicular to the longitudinal axis 11. Bearing portions 16 and 22 have terminal ends 40 and 42 with grooves 44 and 46. Preferably, the grooves 44 and 46 are semi-circular grooves which combine to form a 1½" diameter opening. The grooves 44 and 46 may be of other sizes and shapes as well such that they may cooperatively, and at least partially, surround the periphery of a longitudinal member 72, perpendicular to its longitudinal axis, as shown in FIG. 2.

An unencumbered free space 56, formed between jaw members 12 and 14, is defined by the bearing portions 16 and 22, the transverse portions 28 and 32 and diagonal portions 30 and 34. Preferably the bearing portions 16 and 22 are each 4" in width and 3½" in height such that the total height of the combined bearing portions 16 and 22 is 7". The intermediate portions 20 and 26 and the pulling portions 18 and 24 are also preferably 4" in width although may taper to a width narrower than the bearing portions 16 and 22. Transverse portions 28 and 32 are preferably parallel to longitudinal axis 11 and are 4" in axial length. Therefore, the free space 56 is preferably at least 7"×4"×4" in volume. The jaw members 12 and 14 are preferably made of ½" thick stock throughout. The preferred material is structural steel.

As shown in FIG. 2, located in the pulling portions 18 and 24 are apertures 48 and 50. A clamping bolt 52 passes through apertures 48 and 50 and is threadedly and releasably secured by fastener 54 so as to apply a clamping force across pulling portions 18 and 24. This clamping action is transferred through intermediate portions 20 and 26 and bearing portions 16 and 22 such that there exists a clamping force across terminal ends 40 and 42 of bearing portions 16 and 22 respectively. Clamping bolt 52, preferably, is a ¾" bolt and apertures 48 and 50 should be sized accordingly to receive clamping bolt 52. Spacers 53, such as washers, may be placed about clamping bolt 52 and between pulling portions 18 and 24 to assist in maintaining the clamping force across jaw members 12 and 14 while increasing the spacing therebetween.

Pulling portions 18 and 24 have attachment means, which are preferably apertures 62 and 64. A bolt 58 is fastened by a threaded fastener 60, and is received by the apertures 62 and 64. A U-shaped clevis 66 has apertures 68 and 70 through which bolt 58 also passes. The clevis 66 is significantly greater in height than the combined thickness of pulling portions 18 and 24 such that the separation between pulling portions 18 and 24 may be increased when held within clevis 66. An axial pulling load P applied along axis 11 to the clevis 66 will in turn transfer the load to bolt 58, and accordingly to pulling portions 18 and 24. The apertures 62 and 64 are sized and located to receive bolt 58 such that any pulling force P applied to the bolt, parallel to the longitudinal axis 11, will be approximately equally distributed to each of the jaw members 12 and 14.

FIG. 2 shows clamping apparatus 10 secured about longitudinal member 72, which may be attached to an energy absorbing unit 76. End plate 74 has apertures to receive bolts (not shown) for attachment to a bumper. Grooves 44 and 46 surround the periphery of longitudinal member 72 perpendicular to its longitudinal axis such that bearing portions 16 and 22 are stably supported, i.e., may not slip off of longitudinal member 72. Bearing faces 36 and 38 bear upon end plate 74, thereby placing an axial tensile load upon longitudinal member 72 when clamping apparatus 10 is pulled axially along longitudinal axis 11. Preferably, bearing portions 16 and 22 are sufficiently rigid that the area of bearing of bearing portions 22 and 16 upon end cap 74 is large. This avoids areas of localized high load transfer, such as might occur at the upper and lower periphery of end plate 74 if bearing portions 16 and 22 were excessive flexible. Transferring the load strictly at the lower and upper periphery of end plate 74 would increase the maximum bending moment on end plate 74.

In operation, separated jaw members 12 and 14 are placed about longitudinal member 72 with grooves 44 and 46 located thereabout. A sufficient number of spacers 53 are placed between pulling portions 18 and 24 to keep them generally parallel about axis 11 when a slight clamping force is placed across jaw members 12 and 14. Clamping bolts 52 and bolt 58 are placed through pulling portions 18 and 24 and fastened by fasteners 54 and 60 to complete attachment of clamping apparatus 10 about longitudinal member 72 and end plate 74.

Figure 3:
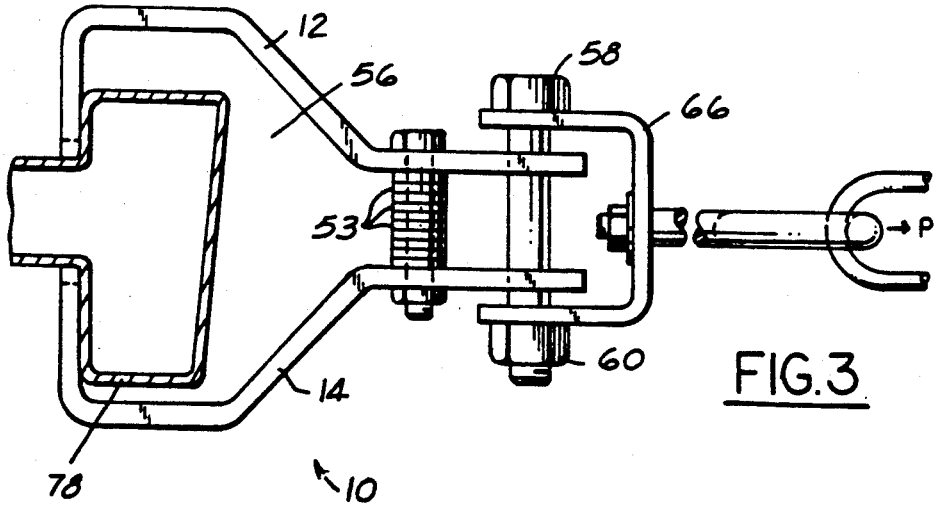
FIG. 3 is a partial top sectional view showing a transverse member, located within an unencumbered space formed between the jaw members, wherein an axial pulling load applied to the clamping apparatus creates a load perpendicular to the longitudinal axis of the transverse member.

Alternatively, as seen in FIG. 3, the free space 56 may have a transverse or beam member 78 located therein. Beam member 78 may be a door jamb, a door pillar, a rocker panel, or the like. Bearing faces 36 and 38 will again bear upon beam member 78 over a large area such that no areas of localized high load transfer exists thereby decreasing the chances of damaging beam member 78.

Ideally, the bearing faces 36 and 38 transfer approximately equal loads to a component captured within free space 56. This is due to a combination of the clamping frictional forces existing between pulling portions 18 and 24 and any washers 53 located therebetween and the approximate equal load transferred to apertures 62 and 64 of pulling portions 18 and 24 by bolt 58 when a pulling load P is applied thereto parallel to longitudinal axis 11. Therefore, the disadvantage of one jaw member carrying and transferring the great majority of the pulling load to a component secured therewithin, as occurs with attachment means attaching to only one jaw member, is avoided.

While the foregoing specification of this invention has been described in relation to certain preferred embodiments thereof, and many details have been set forth for the purpose of illustration, it will be apparent to those skilled in the art that the invention is susceptible to additional embodiments and that certain of the details described herein can vary considerably without departing from the basic principles of the invention.

What is claimed is:

1. A clamping apparatus for securing to and pulling upon an enlarged end of a longitudinal member of a vehicle chassis, the enlarged end comprising a flattened end plate, the apparatus comprising:

a pair of facing jaw members located along a longitudinal axis of the apparatus, each jaw member having a bearing portion, a pulling portion, and an intermediate portion which connects the bearing portion to the pulling portion, the bearing and intermediate portions defining an unencumbered space therebetween sufficiently large to receive the enlarged end of the longitudinal member;

clamping means for releasably clamping the pulling portions to retain the jaw members in facing relation;

a clevis which is attached to the pulling portion of each jaw member, the clevis being greater in height than the combined thickness of the pulling portions in order to allow spacing of the pulling portions away from one another within the clevis;

each bearing portion having a substantially flattened bearing face and a terminal end with a groove located therein, the grooves being sized to cooperatively and substantially surround the periphery of the longitudinal member perpendicular to its longitudinal axis; the bearing faces of the jaw members cooperating to define a substantially planar surface for contacting the flattened end plate of the longitudinal member; and wherein the jaw members may be placed with the grooves substantially surrounding a portion of the longitudinal member so as to prevent the jaw members from sliding off of the longitudinal member and with the bearing faces bearing upon the end plate such that a pulling force axially applied along the longitudinal axis to either of the pulling portions will be transferred to the vehicle chassis primarily through the bearing faces acting upon the flattened end plate, thereby placing an axial tensile load upon the longitudinal member.

2. The clamping apparatus of claim 1 wherein the attachment means is for applying a pulling force to both of the pulling portions and includes an aperture located in each of the pulling portions, the apertures being sized and located to receive a bolt such that any pulling force applied to the bolt, parallel to the longitudinal axis, will be approximately equally distributed to each of the jaw members.

3. The clamping apparatus of claim 1 wherein the pulling portions are parallel to the longitudinal axis when the clamping means are clamping the pulling portions.

4. The clamping apparatus of claim 1 wherein the unencumbered space is at least 7" and 4" in directions perpendicular to the longitudinal axis and 4" in a direction along the longitudinal axis.

5. The clamping apparatus of claim 1 wherein the jaw members are made of at least ½" thick steel.

6. The apparatus of claim 1 wherein the bearing faces are planar and perpendicular to the longitudinal axis.

7. The clamping apparatus of claim 1 wherein the clamping apparatus comprises an aperture in each of the pulling portions, a clamping bolt and a fastener, the apertures being sized and located to receive the clamping bolt.

8. The clamping apparatus of claim 7 wherein the apertures are located in the pulling portions and the pulling portions are parallel to the longitudinal axis.

9. A clamping apparatus for securing to and pulling upon an enlarged end of a longitudinal member of a vehicle chassis, the enlarged end comprising a flattened end plate, the apparatus comprising:

a pair of facing jaw members located along a longitudinal axis of the apparatus, each jaw member having a bearing portion, a pulling portion extending parallel to the longitudinal axis, and a intermediate portion which connects the bearing portion to the pulling portion, the bearing and intermediate portions defining an unencumbered space therebetween sufficiently large to receive the enlarged end of the longitudinal member;

clamping means for releasably clamping the pulling portions to retain the jaw members in facing relation and including a first aperture formed in each of the pulling portions, a clamping bolt and a fastener, the first apertures being sized and located to receive the clamping bolt;

a clevis which is attached to the pulling portion of each jaw member, the clevis being greater in height than the combined thickness of the pulling portion in order to allow spacing of the pulling portions away from one another within the clevis, the clevis applying a pulling force to both of the pulling portions and including a second aperture located in each of the pulling portions, the second apertures being sized and located to receive a bolt such that any pulling force applied to the bolt, parallel to the longitudinal axis, will be approximately equally distributed to each of the jaw members; and each bearing portion having a bearing face and a terminal end with a groove located therein, the grooves being sized to cooperatively and substantially surround the periphery of the longitudinal member perpendicular to its longitudinal axis and the bearing faces being substantially planar and perpendicular to the longitudinal axis, the bearing faces of the two jaw members cooperating to define a substantially planar surface for contacting the flattened end plate of the longitudinal member;

wherein the jaw members may be placed with the grooves substantially surrounding a portion of the longitudinal member so as to prevent the jaw members from sliding off of the longitudinal member and with the bearing faces bearing upon the enlarged end such that a pulling portions will be transferred to the vehicle chassis primarily through the bearing faces acting upon the end plate, thereby placing an axial tensile load upon the longitudinal member.

* * * * *